United States Patent [19]

Bocquet et al.

[11] 4,436,791

[45] Mar. 13, 1984

[54] CAST COLD ROLLING ROLL

[75] Inventors: Jacques Bocquet, Sedan; Jean C. Werquin, Ronchin, both of France

[73] Assignee: Union Siderurgique du Nord et de l'Est de la France, Paris, France

[21] Appl. No.: 316,487

[22] Filed: Oct. 29, 1981

[30] Foreign Application Priority Data

Oct. 31, 1980 [FR] France ..... 80 23316

[51] Int. Cl.[3] ..... C21D 9/38; B21B 27/02

[52] U.S. Cl. ..... 428/682; 148/3; 148/127; 428/685; 29/132

[58] Field of Search ..... 29/132; 75/126 R, 123 CB, 75/126 C, 128 V, 128 W, 126 E; 148/3, 12 R, 12.4, 36, 35, 37, 39, 127; 428/685, 682; 164/114

[56] References Cited

FOREIGN PATENT DOCUMENTS

| | | | |
|---|---|---|---|
| 2086561 | 12/1971 | France | 29/132 |
| 53-97919 | 8/1978 | Japan | 75/123 CB |
| 53-106333 | 9/1978 | Japan | 428/685 |
| 55-28337 | 2/1980 | Japan | 428/685 |
| 55-86670 | 6/1980 | Japan | 428/682 |
| 596653 | 3/1978 | U.S.S.R. | 75/126 C |

*Primary Examiner*—Peter K. Skiff

*Attorney, Agent, or Firm*—Cushman, Darby & Cushman

[57] ABSTRACT

The composite bimetallic roll for cold rolling obtained by casting comprises a heart metal constituted by a nodular or lamellar cast iron and a case metal constituted by a steel having a chromium content of 8 to 16% and a carbon content of 0.65 to 0.95%. The chromium/-carbon ratio is between 11 and 16 and the structure of the case metal is martensitic with a content of residual austenite of less than 10%.

6 Claims, No Drawings

CAST COLD ROLLING ROLL

The present invention relates to working rolls for cold rolling ferrous and non-ferrous metals which are of the composite type and are produced by casting.

Heretofore, there were employed for manufacturing such working rolls for cold rolling, water hardened forged steel rolls in 0.8 to 0.9% carbon and 1.8 to 3% chromium grades. These forged rolls must have a perfect internal condition in order to withstand the considerable tensions created upon the martensitic hardening produced by a sudden cooling in water.

In some cases, in particular when very deep hardening depths are required, the internal tensions created by the water hardening are such that it might be necessary to employ a remelting under slag in order to achieve a perfect crystallization. The chromium content of these rolls may then reach 5 to 7%.

Competition arose between iron-smiths for increasing the hardening depth so as to increase the useful part of the roll in the rolling mill without requiring re-hardening. Thus the useful part of the roll has increased from 30 mm ten years ago to 70 mm, measured on the diameter of the roll. This competition, however, has not substantially improved the resistance to softening which characterizes to a certain extent the resistance to rolling incidents.

More recently, manufacturers of cast rolls have put onto the market a new type of roll consisting of an outer layer of high chromium cast iron and a heart of lamellar or nodular cast iron. These rolls which are characterized by both a high resistance to softening and consequently to incidents and a considerable possibility of utilization of the diameter (>70 mm), take up an ever increasing part of the market and consequently compete against forged rolls heretofore produced.

These high chromium cast iron rolls, the hardnesses of which reach those of water hardened forged steel rolls, however have drawbacks which retard their utilization in rolling mills:

a. They are very difficult to grind.

Indeed, the grinding time for these rolls between two rolling settings, reaches, for a given finishing operation, a time which is at least double that of a forged steel roll.

b. They are more difficult to shot blast or shot peen than forged rolls.

It is even sometimes impossible, in particular when the cast steel rolls are very hard, to obtain high roughness.

An object of the present invention is to overcome these two important drawbacks while retaining the qualities inherent in this type of roll obtained by casting, the essential qualities of which are a good resistance to softening and a great depth of the useful part of the diameter.

The present invention consequently provides a cast composite bimetallic roll for cold rolling, comprising heart metal constituted by nodular or lamellar cast iron and a case metal constituted by a steel having a chromium content of 8 to 16% and a carbon content of 0.65 to 0.95%, the ratio between the chromium and the carbon being between 11 and 16 and the structure of the case metal being martensitic with a residual austenite content of less than 10%.

The structure of the metal roll whose composition has just been defined is obtained by a heat treating method which comprises first subjecting the roll to an austenitisation treatment at a temperature higher than 900° C. for a period of 8 to 24 hours, then, after hardening with air or blown damp air stopped at a temperature of 400° to 500° C., maintaining the temperature at 500° to 550° C. for a period of 8 to 24 hours, cooling the roll by immersion in air until room temperature is reached, and subjecting the roll to a tempering operation for reactivating the austenite at a temperature between 400° and 450° C. for a period of 8 to 24 hours.

The austenitisation treatment is preferably carried out at a temperature between 1 000° and 1 500° C. for a period of 8 to 24 hours. The roll is thereafter subjected to a hardening by blowing surrounding air or damp air or any other equivalent known means which is preferably stopped when the temperature of the roll reaches 500° to 550° C. The roll is then maintained for a period of 8 to 24 hours in an enclosure brought to the previously indicated temperature of 500° to 550° C. so as to achieve an equilibrium between the temperatures of the heart and skin. The temperature of the roll is then brought to the value of the room temperature by a further quenching in air. The roll is then subjected to a tempering treatment at a temperature between about 400° and 450° C. for a period of 8 to 24 hours.

The previously-defined rolls which have the composition and are obtained by the heat treatments defined hereinbefore, have the following five essential properties:

1. Useful depth extending to 100 mm on the diameter.
2. Exceptional resistance to softening when hot at least up to 450° C.
3. High hardness which avoids marking and increases the life of the shot peening.
4. Ease of grinding equal to that of forged steel rolls.
5. Ease of shot peening with high roughness easily achieved.

These five properties in a single type of roll constitute a considerable progress over the state of the art which did not permit conciliating all these advantages.

The composite roll according to the present invention has a layer of casing metal having a thickness of 30 to 70 mm which is preferably produced by centrifugal casting.

This case metal is a steel having a high chromium and carbon content and preferably the following composition:

| | C | Si | Mn | Cr | Ni | Mo | V |
|---|---|---|---|---|---|---|---|
| % | 0.65 / 0.95 | 0.4 / 0.6 | 0.4 / 0.8 | 8 / 11 | — / 0.7 max. | 0.50 / 1.50 | 0.10 / 1 |

The heart metal is preferably a nodular cast iron having the following composition:

| | C | Si | Mn | Ni | Cr |
|---|---|---|---|---|---|
| % | 2.90 / 3.20 | 1.50 / 2.50 | 0.40 / 1 | 0.50 / 2 | <0.15 |

The composition and the heat treatments defined hereinbefore explain the obtainment of the five previously mentioned properties for the following reasons.

1. Deep useful layer (up to 100 mm on the diameter).

This is achieved by means of a martensitic transformation throughout the useful thickness and owing to internal tensions created maintained at the lowest level. The martensitic transformation is achieved by cooling with air and the hardening effect is limited by the connection of the useful layer of the case metal with a heart metal which gives a perlitic transformation upon cooling with air.

The heart metal, which is little alloyed, is therefore constituted by a nodular or lamellar cast iron which permits obtaining both good mechanical characteristics and a good crystallization, these two properties being essential for withstanding the tensile stresses created by the martensitic hardening of the case metal.

2. Resistance to softening when hot.

The analysis of the case metal is chosen with a composition close to that of the matrix of cold working rolls of cast iron having a high chromium content previously employed in the art. The temperings employed on the highly alloyed steel grade according to the present invention do not result in a transformation of the austenite into bainite but in a reactivation of the residual austenite which is transformed in the course of the cooling into martensite to the exclusion of any formation of bainite.

In order to obtain the reactivation of the residual austenite, it is necessary to reach temperatures of more than 400° C. without the hardening martensite being highly sotened.

3. High hardnesses.

After air hardening, the new composite roll according to the present invention permits reaching a hardness of 700 HV (Hardness Vickers) with a content of residual austenite of 30 to 40%.

After tempering, the reactivation of this austenite permits obtaining hardnesses of 760 to 800 HV. These levels of high hardness are those which are usually obtained in cold rolling with conventional forged steel rolls.

4. Ease of grinding.

This property is obtained by the elimination of the presence of ledeburitic carbides of the M7C3 type which were previously present in rolls cast in accordance with the prior art.

Indeed, the particular behaviour of these prior art rolls upon grinding and shot peening may be explained as being the consequence of the presence in the structure of the iron of a large amount of chromium carbides of the M7C3 type the individual hardness of which may be as much as 1 700 HV. These carbides, which are firmly held in a martensitic matrix which is also hard (700 HV), obviously oppose the abrasion action of the grinding wheel and the deformation produced by shot peening which are far from reaching their hardness (the hardest shot reaches 900 to 940 HV). The study of the behaviour of these rolls of high chromium cast iron of the prior art in service shows that the carbide phase of the M7C3 type did not play an important part in the course of the rolling, but on the other hand, resulted in drawbacks encountered when grinding and shot peening.

The composition of the new alloy according to the present invention is calculated, in particular as concerns the carbon and chromium content, to reach a slightly hypereutectoid composition so as to avoid the presence of these harmful ledeburitic carbides.

5. Ease of shot peening, in particular for high roughnesses.

Here again, the absence of massive carbides of the very hard M7C3 type permits an improved effect of plastic deformation of the projected shot as explained hereinbefore.

The study of the composition of the alloy of the case of the roll according to the present invention, the carbon and chromium of which constitute the two main elements, enables the following conclusions to be drawn.

It may be considered that the chromium has a carbon coefficient equivalent to 0.05.

Thus it is clear that the slightly hypereutectoid composition of the alloy is therefore equivalent, as concerns the appearance of the ledeburite, to a steel having a composition $0.7+11\times0.05=1.25\%$ of carbon for the maximum chromium content.

Thus this content is at the lower limit of the appearance of a network of ledeburitic carbides.

Further, in order to obtain the properties of resistance to softening when hot, a sufficient chromium content in the matrix is necessary. The best ratio Cr/C, which determines with the austenitizing temperature the chromium content of the matrix, has been determined experimentally on a whole series of carbon-chromium alloys and must be preferably between 11 and 16.

The other elements, namely Si and Mn, must be within the usual ranges of analyses of cast steels.

The nickel and the manganese are deliberately limited to 0.7% in order to avoid their stabilizing effect on the residual austenite.

The molybdenum and the vanadium improve the resistance to the tempering of the austenite and are within the usual ranges of contents of cold working chromium steels (classes 80 and 90 of the American classification).

There are thus obtained new cast bimetallic composite rolls having an exceptional resistance to softening by the tempering of the matrix.

By way of example, a roll according to the present invention was produced from a case metal and a heart metal having the following composition:

| Analysis of the case metal: | | | | | | | | |
|---|---|---|---|---|---|---|---|---|
| C | Si | Mn | S | P | Cr | Ni | Mo | V |
| 0.715 | 0.470 | 0.705 | 0.025 | 0.020 | 9.60 | 0.68 | 1.150 | 0.535 |

| Analysis of the heart metal: | | | | | | | | |
|---|---|---|---|---|---|---|---|---|
| | | | | | (nodular) cast iron | | | |
| C | Si | Mn | S | P | Cr | Ni | Mo | Mg |
| 3.02 | 2.42 | 0.48 | 0.008 | 0.022 | 0.10 | 0.50 | — | 0.055 |

The roll thus obtained is subjected to an austenitizing treatment for 24 hours at 1 000° C., then to a blown air hardening which is stopped at a temperature of 520° C. The temperature of the roll is then maintained at a value of 520° C. for a period of 20 hours and then the roll is cooled to room temperature by quenching in air.

After quenching, it has a hardness of 692 HV and an austenite content of 40.6%.

This roll is then tempered at a temperature higher than 400° C. for a period of 20 hours, which produces at the end of the treatment a hardness of 780 HV on 50 mm of the radius.

This roll has been used for the cold rolling of thin sheet metal and has confirmed the previously-mentioned advantages.

Having now described our invention that we claim as new and desire to secure by Letters Patent is:

1. A cast bimetallic composite roll for cold rolling, comprising in combination a heart metal constituted by a nodular or lamellar cast iron and a case metal constituted by a steel having a chromium content of 8 to 16% and a carbon content of 0.65 to 0.95%, the ratio between the chromium and carbon being between 11 and 16 and the structure of the case metal being martensitic with a residual austenite content of less than 10% and a hardness exceeding 700 HV.

2. A roll according to claim 1, wherein the case metal has a thickness of substantially 30 to 70 mm.

3. A roll according to claim 1 or 2, wherein the case metal has the following composition:

| | C | Si | Mn | Cr | Ni | Mo | V |
|---|---|---|---|---|---|---|---|
| % | 0.65 / 0.95 | 0.4 / 0.6 | 0.4 / 0.8 | 8 / 11 | — / 0.7 max. | 0.50 / 1.50 | 0.10 / 1 |

4. A roll according to claim 1 or 2, wherein the heart metal is a nodular cast iron having the following composition:

| | C | Si | Mn | Ni | Cr |
|---|---|---|---|---|---|
| % | 2.90 / 3.20 | 1.50 / 2.50 | 0.40 / 1 | 0.50 / 2 | <0.15 |

5. A roll according to claim 3, wherein the case metal has the following composition, in percent:

| C | Si | Mn | S | P | Cr | Ni | Mo | V |
|---|---|---|---|---|---|---|---|---|
| 0.715 | 0.470 | 0.705 | 0.025 | 0.020 | 9.60 | 0.68 | 1.150 | 0.535 |

6. A roll according to claim 4, wherein the heart metal has the following compositions, in percent:

| C | Si | Mn | S | P | Cr | Ni | Mo | Mg |
|---|---|---|---|---|---|---|---|---|
| 3.02 | 2.42 | 0.48 | 0.008 | 0.022 | 0.10 | 0.50 | — | 0.055 |

* * * * *